US012797666B2

(12) United States Patent
Hu

(10) Patent No.: US 12,797,666 B2
(45) Date of Patent: Nov. 17, 2026

(54) WATER RESISTANCE ROWING MACHINE

(71) Applicant: Zhejiang Yunbu Intelligent Technology Co., Ltd, Jinhua (CN)

(72) Inventor: Huaguang Hu, Jinhua (CN)

(73) Assignee: Zhejiang Yunbu Intelligent Technology Co, LTD., Jinhua (CN)

( * ) Notice: Subject to any disclaimer, the term of this patent is extended or adjusted under 35 U.S.C. 154(b) by 51 days.

(21) Appl. No.: 18/962,830

(22) Filed: Nov. 27, 2024

(65) Prior Publication Data

US 2025/0319343 A1 Oct. 16, 2025

(30) Foreign Application Priority Data

| | | |
|---|---|---|
| Apr. 12, 2024 | (CN) | 202420749527.3 |
| Apr. 12, 2024 | (CN) | 202420749531.X |
| Nov. 14, 2024 | (CN) | 202411626237.0 |
| Nov. 14, 2024 | (CN) | 202422778282.X |

(51) Int. Cl.

| | |
|---|---|
| ***A63B 21/008*** | (2006.01) |
| ***A63B 21/00*** | (2006.01) |
| ***A63B 22/00*** | (2006.01) |

(52) U.S. Cl.

CPC ..... *A63B 21/0084* (2013.01); *A63B 21/4034* (2015.10); *A63B 22/0076* (2013.01)

(58) Field of Classification Search

CPC ..... A63B 21/0084; A63B 21/4034; A63B 21/0552; A63B 21/008–0089; A63B 22/0076–0089; A63B 2022/0079–0089

See application file for complete search history.

(56) References Cited

U.S. PATENT DOCUMENTS

| | | | | |
|---|---|---|---|---|
| 1,979,783 | A * | 11/1934 | Williams | A63B 22/0076 482/72 |
| 6,561,955 | B1 * | 5/2003 | Dreissigacker | A63B 21/0088 482/57 |
| 8,708,867 | B2 * | 4/2014 | Lumsden | A63B 21/0084 482/73 |
| 9,662,534 | B1 * | 5/2017 | Liu | A63B 21/0051 |
| 10,493,310 | B2 * | 12/2019 | King | A63B 23/03575 |
| 10,828,530 | B1 * | 11/2020 | Vujicic | A63B 21/153 |

(Continued)

FOREIGN PATENT DOCUMENTS

| | | | | |
|---|---|---|---|---|
| CN | 108704249 | A * | 10/2018 | A63B 21/008 |
| CN | 114470616 | A * | 5/2022 | A63B 21/222 |

(Continued)

*Primary Examiner* — Nyca T Nguyen

(57) ABSTRACT

The present application belongs to the field of design of fitness equipment, and discloses a water resistance rowing machine, including a support frame body, being strip-shaped and provided with a slideway; a seat, used for an exerciser to sit down and exercise and slidingly connected to the slideway; a pedal portion, fixedly connected to the support frame body, located on left and right sides of the support frame body and used for the exerciser to tread with his/her feet during exercising; a water resistance tank, fixedly connected to the support frame body through a water resistance tank bracket and internally provided with an adjustable paddle structure; a transmission portion, fixedly connected to the support frame body; and a resilient handheld structure, including a hollow pipe body and a handheld portion arranged outside the hollow pipe body.

7 Claims, 3 Drawing Sheets

(56) References Cited

U.S. PATENT DOCUMENTS

| | | | | |
|---|---|---|---|---|
| 11,318,343 | B2 * | 5/2022 | Hsieh | A63B 21/4035 |
| 2003/0134719 | A1 * | 7/2003 | Liou | A63B 22/0076 482/72 |
| 2016/0144223 | A1 * | 5/2016 | Dalebout | A63B 22/0087 482/72 |
| 2018/0056118 | A1 * | 3/2018 | Bates | A63B 22/0087 |
| 2018/0117393 | A1 * | 5/2018 | Ercanbrack | A63B 22/001 |
| 2019/0118021 | A1 * | 4/2019 | Liu | A63B 21/0084 |
| 2020/0282256 | A1 * | 9/2020 | Boyles | A63B 22/0046 |
| 2020/0384305 | A1 * | 12/2020 | Hsieh | A63B 21/0084 |
| 2021/0170221 | A1 * | 6/2021 | Hsu | A63B 21/153 |
| 2021/0275858 | A1 * | 9/2021 | Ross | A63B 22/0015 |
| 2022/0040526 | A1 * | 2/2022 | Chang | A63B 21/0051 |
| 2022/0143456 | A1 * | 5/2022 | Lammers | A63B 21/154 |
| 2023/0077418 | A1 * | 3/2023 | Qiu | A63B 21/15 482/72 |
| 2024/0024730 | A1 * | 1/2024 | Cai | A63B 21/22 |
| 2024/0307734 | A1 * | 9/2024 | Fang | A63B 22/0076 |
| 2024/0316382 | A1 * | 9/2024 | Hsu | A63B 21/00069 |

FOREIGN PATENT DOCUMENTS

| | | | | |
|---|---|---|---|---|
| CN | 111150963 | B * | 4/2025 | A63B 69/06 |
| DE | 102021001974 | B3 * | 8/2022 | A63B 69/08 |
| FR | 2771933 | A3 * | 6/1999 | A63B 21/153 |
| GB | 2412605 | A * | 10/2005 | A63B 21/225 |

* cited by examiner

WATER RESISTANCE ROWING MACHINE

CROSS-REFERENCE TO RELATED APPLICATIONS

This application claims priorities from the Chinese patent application 202420749531X filed Apr. 12, 2024, 2024207495273 filed Apr. 12, 2024, 202422778282X, filed Nov. 11, 2024, and 2024116262370 filed Nov. 11, 2024, the content of which are incorporated herein in the entirety by reference.

TECHNICAL FIELD

The present application belongs to the field of design of fitness equipment, and relates to a water resistance rowing machine.

BACKGROUND

A water resistance rowing machine is a kind of rowing machine, has a water tank, and can simulate a real rowing mode when an exerciser is exercising, so that the exerciser can truly feel that he/she is paddling, thereby achieving a significant effect on muscle enhancement of legs, waist, upper limbs, chest and back.

Paddles are arranged in the water tank. In an existing water resistance rowing machine, the maximum resistance of the water resistance rowing machine is changed by increasing and reducing the number of the paddles. Meanwhile, the volume of the water tank will change accordingly.

SUMMARY

An objective of the present application is to provide a water resistance rowing machine with an angle-adjustable fixed paddle structure, which can adjust the load according to the requirements of exercisers to enlarge the application range of the rowing machine.

To achieve the aforementioned objective, the specific technical solution of the present application is as follows: a water resistance rowing machine includes:

- a support frame body, being strip-shaped and provided with a slideway;
- a seat, used for an exerciser to sit down and exercise and slidingly connected to the slideway;
- a pedal portion, fixedly connected to the support frame body, located on left and right sides of the support frame body and used for the exerciser to tread with his/her feet during exercising;
- a water resistance tank, fixedly connected to the support frame body through a water resistance tank bracket and internally provided with an adjustable paddle structure;
- a transmission portion, fixedly connected to the support frame body and including:
- a wheel disc, a connecting shaft being arranged at the center of the wheel disc, and one end of the connecting shaft being coaxially connected to the adjustable paddle structure in the water resistance tank, and
- a belt, wound at the periphery of the wheel disc, the belt being a multi-wedge belt, and correspondingly, an annular groove in matched connection with the multi-wedge belt being formed at the periphery of the wheel disc; and
- a resilient handheld structure, including a hollow pipe body and a handheld portion arranged outside the hollow pipe body, an elastic band being arranged in the hollow pipe body, one end of the elastic band being fixedly connected to the handheld portion, and the other end of the elastic band being fixedly connected to an end of the belt.

The adjustable paddle structure is used to adjust a load. When the elastic band is pulled, the load changes, and the exerciser can adjust rotation angles of paddles according to his/her training intensity.

According to the present application, further, a support is arranged at the bottom of the support frame body, and a friction pad is arranged at the bottom of the support, thereby avoiding friction with a placing surface and reducing the probability of damage to the placing surface.

According to the present application, further, a pulley is arranged on a top surface of the support, thereby facilitating the movement of the rowing machine and reducing the carrying difficulty.

According to the present application, further, the adjustable paddle structure includes a rotating shaft, one end of the rotating shaft being connected to a rear cover of the water resistance tank and the other end of the rotating shaft being connected to the transmission portion; the rotating shaft is connected to an angle-adjustable structure; and the angle-adjustable structure is connected to the paddles to adjust and lock inclination angles of the paddles, thereby adjusting and locking the angles of the paddles, and avoiding the load change during use.

According to the present application, further, the angle-adjustable structure includes a first bevel gear set sleeved on the rotating shaft;

- the first bevel gear set includes first bevel gears and a long connecting shaft, the long connecting shaft is sleeved at the periphery of the rotating shaft, two ends of the long connecting shaft are connected to the first bevel gears, and the periphery of the first bevel gear set is connected to the paddles; and
- second bevel gears engaged with the first bevel gears are arranged at ends of the paddles.

According to the present application, further, the angle-adjustable structure further includes a second bevel gear set arranged at an end of the rotating shaft close to the rear cover of the water resistance tank; and

- the second bevel gear set includes a short connecting shaft and first bevel gears connected to two ends of the short connecting shaft, and the short connecting shaft is shorter than the long connecting shaft.

According to the present application, further, the water resistance rowing machine further includes a rotary locking switch arranged on a shell of the water resistance tank, where the top of the rotary locking switch is located above the shell of the water resistance tank, the top of the rotary locking switch is provided with a rotary knob, and a third bevel gear engaged with the first bevel gears connected to the short connecting shaft is arranged at the bottom of the rotary locking switch through a connecting rod.

According to the present application, further, the rotating shaft is a circular shaft, two opposite key grooves extending in a length direction of the rotating shaft are formed at the periphery of the rotating shaft, and correspondingly, a sleeve is arranged at the periphery of the rotating shaft, and an inner wall of the sleeve has protrusions matched with the key grooves, thereby implementing the matched connection between the rotating shaft and the sleeve.

According to the present application, further, the connecting rod is of a hollow structure and a segmented structure, and the connecting rod has an up-and-down penetrating water injection hole, thereby improving the convenience of injecting water into the water resistance tank.

According to the present application, further, rotation angles of the paddles range from 0° to 360°, thereby enlarging the adjustment range of the load.

100—support frame body,
110—slideway,
120—support,
121—friction pad,
122—pulley,
200—seat,
300—water resistance tank,
310—rotary locking switch,
311—rotary knob,
312—connecting rod,
3121—water injection hole,
313—third bevel gear,
400—transmission portion,
500—handheld structure,
510—hollow pipe body,
520—handheld portion,
530—elastic band,
600—pedal portion,
700—rotating shaft,
710—first bevel gear set,
711—first bevel gear,
712—long connecting shaft,
720—second bevel gear set,
721—short connecting shaft,
800—paddle,
810—second bevel gear.

DETAILED DESCRIPTION

The specific embodiments of the present application are further described below with reference to the accompanying drawings. It should be noted here that the description of these embodiments is intended to help understand the present application, but is not intended to limit the present application. In addition, the technical features involved in the various embodiments of the present application described below may be combined with each other as long as they do not constitute a conflict with each other.

Figure 1:
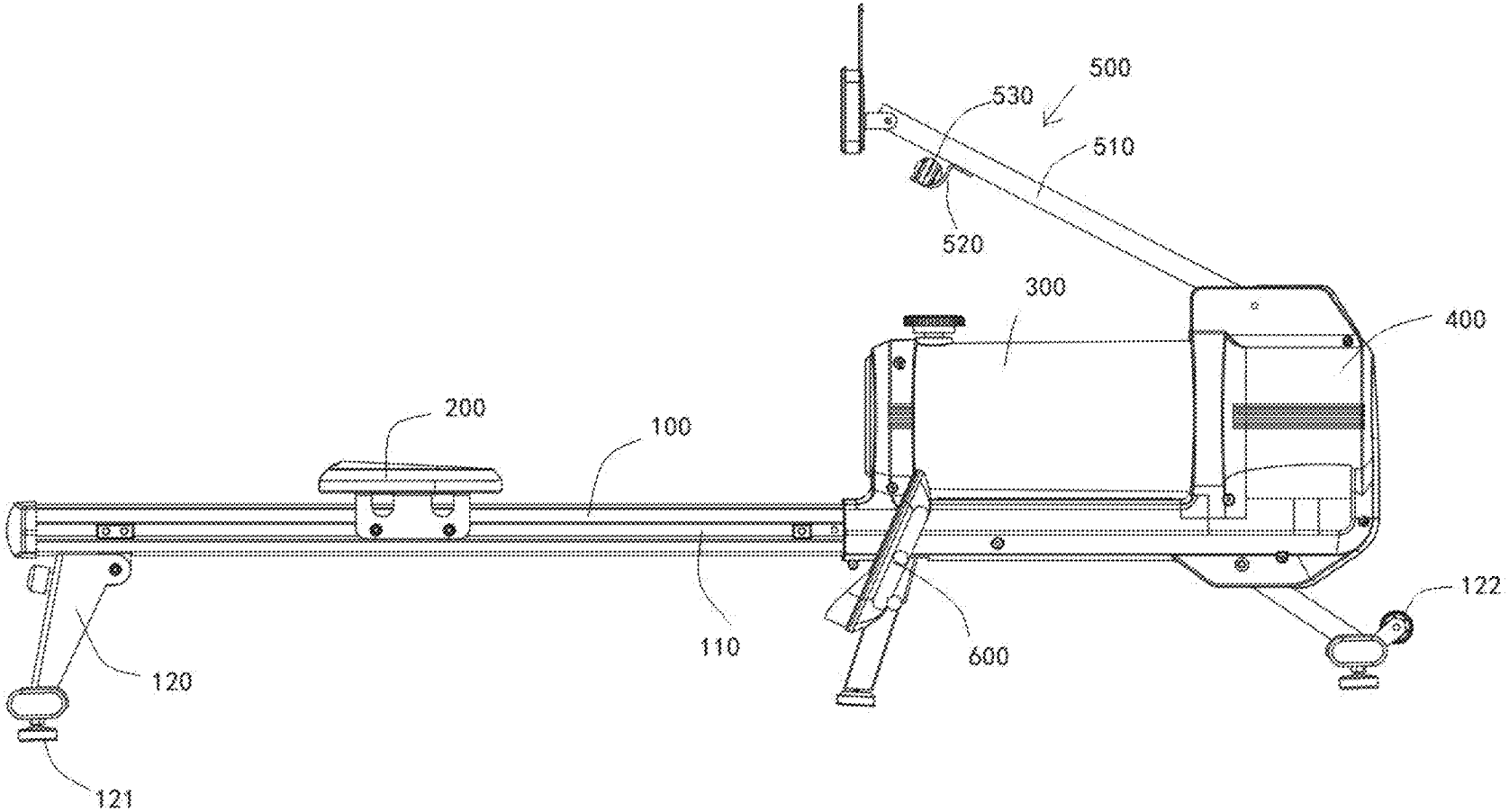
FIG. 1 is a structural schematic diagram of a water resistance rowing machine according to the present application from a first perspective.
Figure 2:
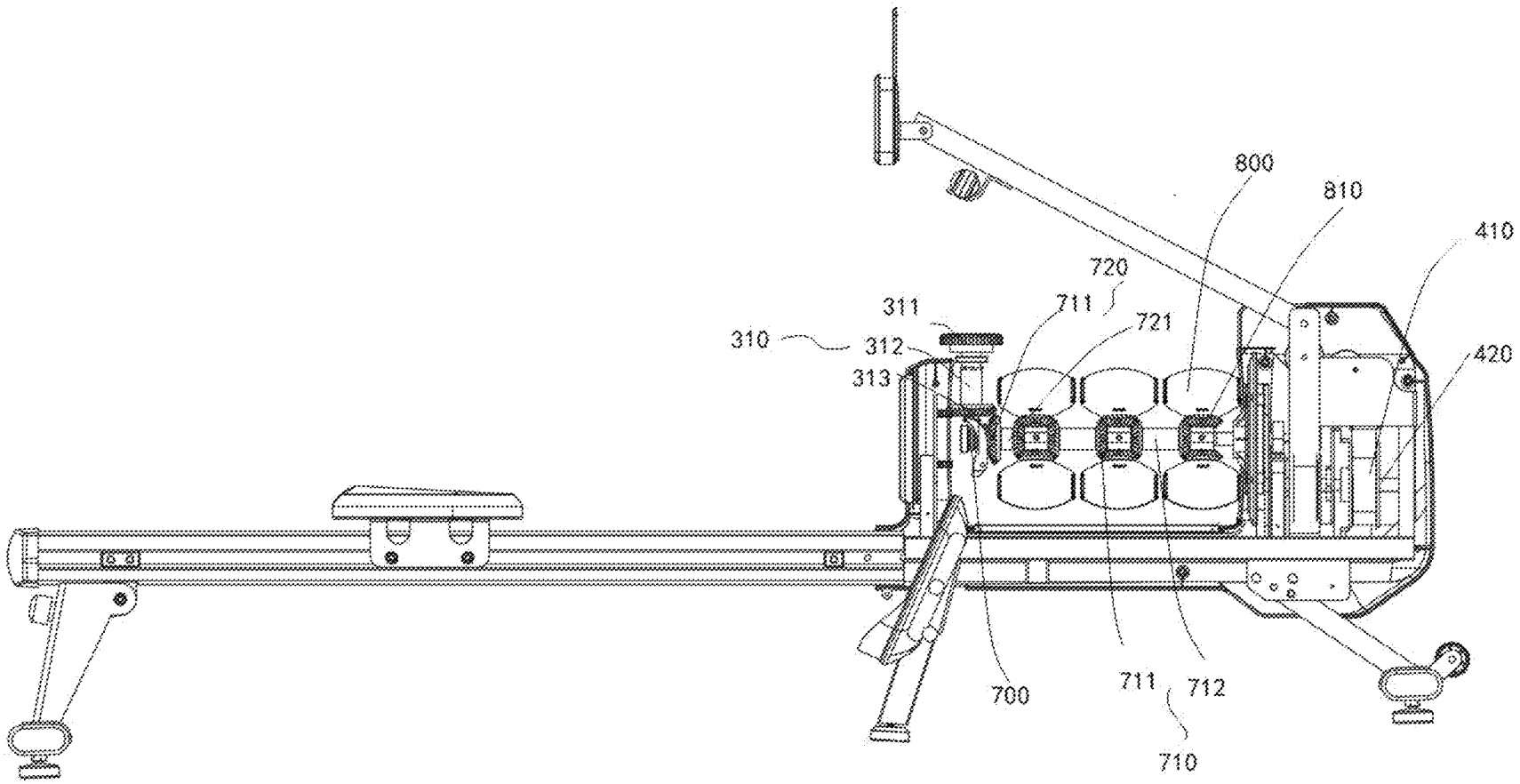
FIG. 2 is a schematic diagram of a water resistance rowing machine (not including a water resistance tank and a shell of a transmission portion) according to the present application.
Figure 3:
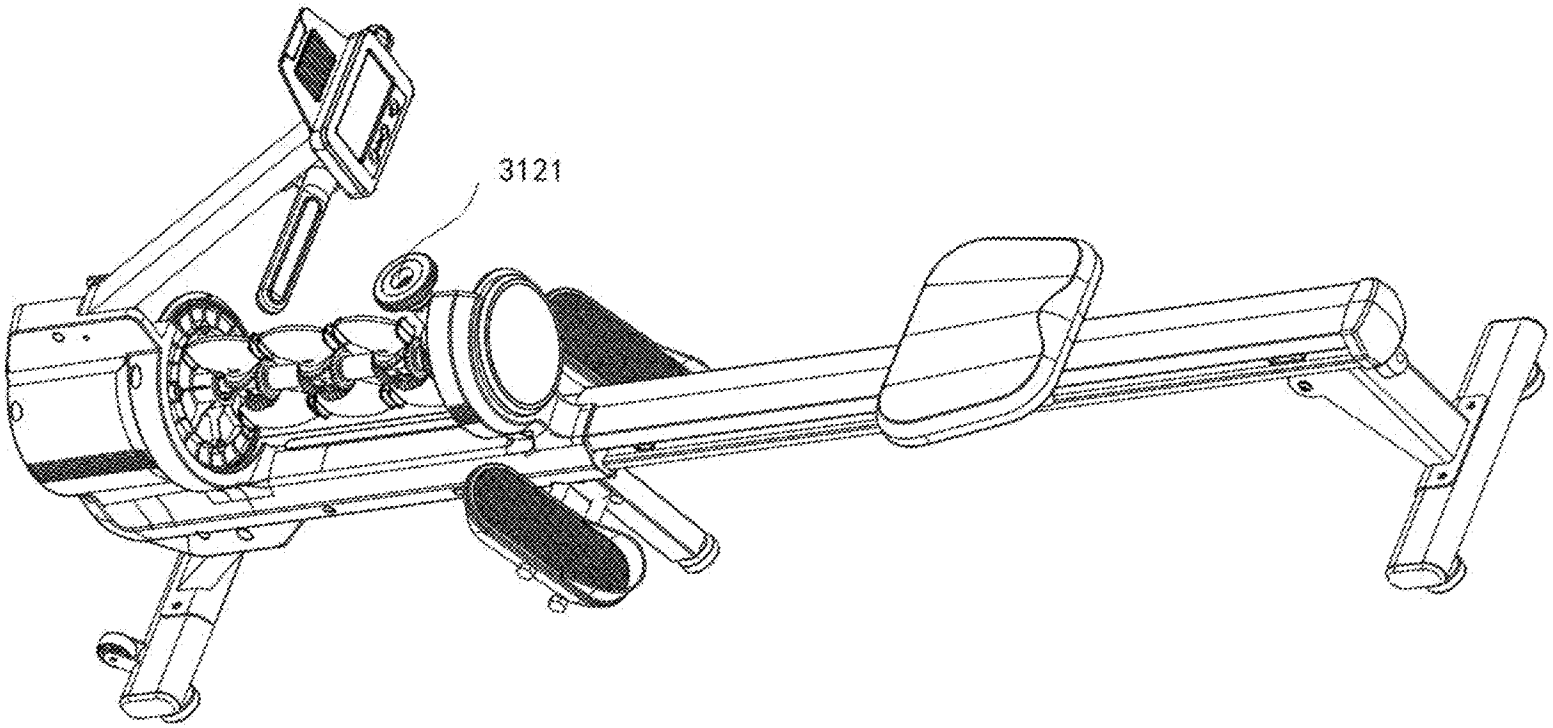
FIG. 3 is a structural schematic diagram of a water resistance rowing machine according to the present application from a second perspective.

The present application provides a water resistance rowing machine, as shown in FIG. 1 to FIG. 3, including a support frame body 100, the support frame body 100 is strip-shaped, a slideway 110 is arranged on the support frame body 100, the support frame body 100 is slidingly connected to a seat 200, the support frame body 100 is further fixedly connected to a pedal portion 600, and the pedal portion 600 includes pedals located on left and right sides of the support frame body 100; when an exerciser sits on the seat 200 when exercising, his/her feet respectively step on the pedals on the corresponding sides to avoid the contact between the feet and the ground, a handheld portion 520 described in detail below is pulled by hands; and with the pulling of the handheld portion 520, the seat 200 is driven to slide along the slideway 110, thereby exercising the arm strength.

The support frame body 100 is further fixedly connected to a water resistance tank 300 and a transmission portion 400 for transmitting motion, the resistance of the water resistance tank 300 is applied by the transmission portion 400 to the exerciser, a resilient handheld structure 500 for the exerciser to hold is arranged on the transmission portion 400, and the resilient handheld structure 500 includes a hollow pipe body 510 and a handheld portion 520 arranged outside the hollow pipe body 510. The hollow pipe body 510 is preferably a hollow square pipe, an elastic band 530 is arranged in the hollow pipe body 510, one end of the elastic band 530 is fixedly connected to the handheld portion 520, and the other end of the elastic band penetrates through a hollow structure of the hollow pipe body 510 to be connected to the transmission portion 400. The water resistance tank 300 is filled with liquid, the exerciser sits on the seat 200, his/her feet respectively step on the pedal portion 600 on the corresponding sides, the handheld portion 520 is held by hands, the handheld portion 520 is pulled, his/her body leans back, the elastic band 530 stretches under the action of a pull of the exerciser, the exerciser's hip drives the seat 200 to slide toward the water resistance tank 300, the elastic band 530 rebounds by the own elastic force to pull the upper body of the exerciser to move toward the water resistance tank 300, and the hip drives the seat 200 to move away from the water resistance tank 300 in a length direction of the support frame body 100, thereby achieving a reciprocating training.

The transmission portion 400 includes a wheel disc 410 and a belt 420 wound at the periphery of the wheel disc 410, an end of the belt 420 is fixedly connected to the elastic band 530, and the connecting shaft connected to the center of the wheel disc 410 is connected to the rotating shaft 700 in the water resistance tank 300, thereby achieving the connection between the transmission portion 400 and a paddle adjusting structure in the water resistance tank 300. Preferably, the belt 420 is a multi-wedge belt. Specifically, tooth forms are arranged in parallel in a length direction of the belt. Correspondingly, open grooves at the periphery of the wheel disc 410 are annular grooves, a plurality of annular grooves are distributed axially along a peripheral surface of the wheel disc 410, and the annular grooves of the wheel disc 410 are engaged with the tooth forms of the belt 420. Compared with an existing synchronous belt, the multi-wedge belt cooperates with the wheel disc 410, so that the transmission portion is stable in transmission, and left-right swaying in the axial direction of the wheel disc 410 is not easy to occur.

Further, a support 120 is arranged at the bottom of the support frame body 100, and two supports 120 are respectively located on two sides of the support frame body 100 in the length direction. Since the rowing machine is heavy, in order to avoid friction on a placing surface and the wear of the placing surface, friction pads 121 are arranged at the bottoms of the supports 120, so that the direct contact between the supports 120 and the placing surface can be avoided, and in the motion process of the exerciser, the friction of the supports 120 on the placing surface and damage to the placing surface can be reduced.

To facilitate the movement and carrying of the rowing machine, a pulley 122 is arranged on top surfaces or close to top surfaces of the supports 120. One pulley 122 may be provided. Preferably, to facilitate dragging, pulleys 122 can be used in pairs. During use, the other end of the support frame body 100 is lifted, so that the pulley 122 is in contact with the ground; and pulling the support frame body 100 enables the pulley 122 to slide on the ground, and the support frame body 100 is driven to move, thereby saving time and labor during carrying.

To increase the water resistance to adapt to the requirements of different exercisers on the load, as shown in FIG. 5, a rotating shaft 700 is arranged in the water resistance tank 300, one end of the rotating shaft 700 is connected to the transmission portion 400, and the other end of the rotating shaft is connected to a rear cover of the water resistance tank 300. A first bevel gear set 710 and a second bevel gear set 720 are sleeved at the periphery of the rotating shaft 700, one second bevel gear set 720 is arranged at an end of the rotating shaft 700 close to the rear cover, and the first bevel gear set 710 is arranged between the second bevel gear set 720 and the transmission portion 400; the first bevel gear set 710 includes first bevel gears 711 and a long connecting shaft 712, the long connecting shaft 712 is of a hollow structure, two ends of the long connecting shaft are connected to the first bevel gears 711, the periphery of the bevel gear set 710 is connected to paddles 800, and second bevel gears 810 engaged with the first bevel gears 711 are arranged at ends of the paddles 800; and the second bevel gear set 720 includes a short connecting shaft 721 and first bevel gears 711 connected to two ends of the short connecting shaft 721, and the short connecting shaft 721 is shorter than the long connecting shaft 712. Preferably, three groups of paddles 800 are provided, and two paddles in each group are arranged symmetrically about the axis of the rotating shaft 700.

In the embodiments of the present application, the rotating shaft 700 is a circular shaft and convenient to process, two opposite key grooves extending in a length direction are formed at the periphery of the rotating shaft 700, and correspondingly, a sleeve is arranged at the periphery of the rotating shaft 700, and an inner wall of the sleeve has protrusions matched with the key grooves, thereby achieving the matched connection between the rotating shaft 700 and the sleeve; and the relative position of the rotating shaft 700 and the sleeve will not change during rotation, so that the accuracy of adjusting the paddles is improved.

To conveniently adjust the rotation angles of the first bevel gear set 710 and the second bevel gear set 720, the shell of the water resistance tank 300 is connected to a rotary locking switch 310, the top of the rotary locking switch 310 is located above the shell of the water resistance tank 300, the top of the rotary locking switch 310 is provided with a rotary knob 311, and a third bevel gear 313 engaged with the first bevel gears 711 connected to the short connecting shaft 721 is arranged at the bottom of the rotary locking switch 310 through a connecting rod, the rotary knob 311 is rotated, and the first bevel gears 711 connected to the short connecting shaft 721 are driven by the third bevel gear 313 to rotate, so that the paddles 800 are driven by the first bevel gear set 710 to rotate, the angle after rotation is locked, the rotation angle ranges from 0° to 360°, and the resistance of liquid in the water resistance tank 300 is increased by changing the angles of the paddles 800, thereby adjusting the load of the water resistance tank 300.

Further, the connecting rod 312 of the rotary locking switch 310 is of a hollow structure and a segmented structure, an upper segment is sleeved at the periphery of a lower segment, and the connecting rod 312 has a water injection hole 3121. When water injection is required, the connecting rod 312 is pulled upward, the third bevel gear 313 is separated from the first bevel gears 711 connected to the short connecting shaft 721, the bottom of the connecting rod 312 is penetrating, water is injected into the water resistance tank 300 through the water injection hole 3121, the water enters the water resistance tank 300 through the bottom of the connecting rod 312 to complete water injection of the water resistance tank 300, the connecting rod 312 is pushed downward after water injection, so that the third bevel gear 313 is engaged with the first bevel gears 711 connected to the short connecting haft 721.

The basic principles, main features and advantages of the present application are shown and described above. It should be understood by those skilled in the art that the present application is not limited by the above embodiments, the descriptions in the above embodiments and the specification are only the principles in the present application, there will be various changes and improvements in the present application without departing from the spirit and scope of the present application, and these changes and improvements will fall into the protection scope of the present application. The protection scope of the present application is defined by the appended claims and their equivalents.

What is claimed is:

1. A water resistance rowing machine, comprising:

a support frame body, being strip-shaped and provided with a slideway;

a seat, used for an exerciser to sit down and exercise and slidingly connected to the slideway;

a pedal portion, fixedly connected to the support frame body, located on left and right sides of the support frame body and used for the exerciser to tread with his/her feet during exercising;

a water resistance tank, fixedly connected to the support frame body through a water resistance tank bracket and internally provided with an adjustable paddle structure;

a transmission portion, fixedly connected to the support frame body; and a resilient handheld structure, comprising a hollow pipe body and a handheld portion arranged outside the hollow pipe body, an elastic band being arranged in the hollow pipe body, one end of the elastic band being fixedly connected to the handheld portion, and the other end of the elastic band being fixedly connected to an output end of the transmission portion;

wherein the adjustable paddle structure comprises a rotating shaft, one end of the rotating shaft being connected to a rear cover of the water resistance tank and the other end of the rotating shaft being connected to the transmission portion; the rotating shaft is connected to an angle-adjustable structure; and the angle-adjustable structure is connected to paddles to adjust and lock inclination angles of the paddles;

wherein the angle-adjustable structure comprises a first bevel gear set sleeved on the rotating shaft;

the first bevel gear set includes first bevel gears and a long connecting shaft, the long connecting shaft is sleeved at the periphery of the rotating shaft, two ends of the long connecting shaft are connected to the first bevel gears, and the periphery of the first bevel gear set is connected to the paddles; and second bevel gears engaged with the first bevel gears are arranged at ends of the paddles.

2. The water resistance rowing machine according to claim 1, wherein the angle-adjustable structure further comprises a second bevel gear set arranged at an end of the rotating shaft close to the rear cover of the water resistance tank; and the second bevel gear set comprises a short connecting shaft and first bevel gears connected to two ends of the short connecting shaft, and the short connecting shaft is shorter than the long connecting shaft.

3. The water resistance rowing machine according to claim 2, further comprising a rotary locking switch arranged on a shell of the water resistance tank, wherein the top of the rotary locking switch is located above the shell of the water resistance tank, the top of the rotary locking switch is provided with a rotary knob, and a third bevel gear engaged with the first bevel gears of the second bevel gear set connected to the short connecting shaft is arranged at the bottom of the rotary locking switch through a connecting rod.

4. The water resistance rowing machine according to claim 3, wherein the connecting rod is of a hollow structure and a segmented structure, and the connecting rod has an up-and-down penetrating water injection hole.

5. The water resistance rowing machine according to claim 1, wherein a support is arranged at the bottom of the support frame body, a friction pad is arranged at the bottom of the support, and a pulley is arranged on a top surface of the support.

6. The water resistance rowing machine according to claim 1, wherein the rotating shaft is a circular shaft, two opposite key grooves extending in a length direction of the rotating shaft are formed at the periphery of the rotating shaft, and correspondingly, a sleeve is arranged at the periphery of the rotating shaft, and an inner wall of the sleeve has protrusions matched with the key grooves, thereby implementing the matched connection between the rotating shaft and the sleeve.

7. The water resistance rowing machine according to claim 1, wherein rotation angles of the paddles range from 0° to 360°.

* * * * *